US011460276B2

(12) United States Patent
Howe et al.

(10) Patent No.: US 11,460,276 B2
(45) Date of Patent: Oct. 4, 2022

(54) RAZOR WIRE CONTAINER WITH ACCESS OPENING

(71) Applicant: Allied Tube & Conduit Corporation, Harvey, IL (US)

(72) Inventors: William Tyler Howe, Worcester, MA (US); Carmen Samara, Homer Glen, IL (US)

(73) Assignee: ALLIED TUBE & CONDUIT CORPORATION, Harvey, IL (US)

( * ) Notice: Subject to any disclaimer, the term of this patent is extended or adjusted under 35 U.S.C. 154(b) by 232 days.

(21) Appl. No.: 16/538,952

(22) Filed: Aug. 13, 2019

(65) Prior Publication Data

US 2020/0056862 A1 Feb. 20, 2020

Related U.S. Application Data

(60) Provisional application No. 62/764,687, filed on Aug. 15, 2018.

(51) Int. Cl.

| | |
|---|---|
| ***E04H 17/16*** | (2006.01) |
| ***F41H 11/08*** | (2006.01) |
| ***E04H 17/18*** | (2006.01) |
| ***E04H 17/04*** | (2006.01) |

(52) U.S. Cl.

CPC ..... *F41H 11/08* (2013.01); *E04H 17/045* (2021.01); *E04H 17/05* (2021.01); *E04H 17/163* (2013.01); *E04H 17/18* (2013.01)

(58) Field of Classification Search

CPC ..... E01F 13/02; F41H 11/08; E04H 17/04; E04H 17/045; E04H 17/05; E04H 17/161; E04H 17/163; E04H 17/16; E04H 17/18

See application file for complete search history.

(56) References Cited

U.S. PATENT DOCUMENTS

| | | | | |
|---|---|---|---|---|
| 1,214,705 A * | 2/1917 | Neely | ..... | E04H 17/16 256/31 |
| 2,835,223 A * | 5/1958 | Erickson | ..... | A01K 3/00 119/502 |
| 3,651,851 A | 3/1972 | Curtis | | |
| 4,003,178 A * | 1/1977 | Douthwaite | ..... | E01F 13/022 52/664 |

(Continued)

FOREIGN PATENT DOCUMENTS

| | | | | |
|---|---|---|---|---|
| BE | 1008506 * | 5/1996 | ..... | E04H 17/163 |
| CN | 201180373 Y | 1/2009 | | |

(Continued)

OTHER PUBLICATIONS

Extended European Search Report for Application No. 19191232.8, dated Jan. 7, 2020, 7 pages.

(Continued)

*Primary Examiner* — Michael P Ferguson
(74) *Attorney, Agent, or Firm* — KDB

(57) ABSTRACT

A razor wire barrier is disclosed. In some embodiments, an enclosure includes a plurality of panel sections rotatably coupled together, at least one panel section of the plurality of panel sections including a first frame component directly coupled to a second frame component of an adjacent panel section. The enclosure may further include a razor wire panel extending across each of plurality of panel sections.

16 Claims, 4 Drawing Sheets

(56) References Cited

U.S. PATENT DOCUMENTS

| | | | | |
|---|---|---|---|---|
| 6,581,914 | B2 * | 6/2003 | Saura Sotillos | E04H 17/161 256/35 |
| 6,997,138 | B1 | 2/2006 | Simpson | |
| 8,864,109 | B2 * | 10/2014 | Cochrane | E04H 17/16 256/24 |
| 2004/0112550 | A1 | 6/2004 | Green | |
| 2006/0289845 | A1 | 12/2006 | Pesta | |

FOREIGN PATENT DOCUMENTS

| | | | | | |
|---|---|---|---|---|---|
| CN | 107964886 | A | | 4/2018 | |
| EP | 2 418 340 | | * | 2/2012 | E04H 17/16 |
| WO | 2004048720 | A2 | | 6/2004 | |
| WO | 2010111513 | A1 | | 9/2010 | |
| WO | 2012048371 | A1 | | 4/2012 | |
| WO | WO 2015/154103 | | * | 10/2015 | E04H 17/04 |
| WO | 2018129589 | A1 | | 7/2018 | |

OTHER PUBLICATIONS

Search Report and Written Opinion dated Apr. 28, 2020, in corresponding Singapore Patent Application No. 10201907416V, 10 pages.

* cited by examiner

RAZOR WIRE CONTAINER WITH ACCESS OPENING

CROSS-REFERENCE TO RELATED APPLICATION

This application claims priority to U.S. Provisional Patent Application No. 62/764,687 filed Aug. 15, 2018, entitled "Razor Panel Barrier," and incorporated by reference herein in its entirety.

BACKGROUND OF THE DISCLOSURE

Field of the Disclosure

The present disclosure relates generally to access security and, more particularly, to a deployable razor panel barrier for access security.

Discussion of Related Art

Many barriers exist for providing a deterrent to ingress into and/or egress from a secured area. One known apparatus is a barbed or razor wire fence comprised of a plurality of strands of spaced wires supported by a plurality of horizontally spaced posts. Another known apparatus is a mesh wire fence, which may also be supported by a plurality of horizontally spaced posts. Each apparatus may also be topped by a plurality of strands of barbed/razor wire inclined at an angle towards the outside of the secured area and, in some instances, a plurality of strands of barbed/razor wire inclined at an angle towards the inside of the secured area. Such angularly oriented strands of barbed/razor wire are provided for preventing a human from climbing the security fence and then climbing upwardly over the top of the security fence. In other known apparatuses, one or more layers of concertina razor wire may be coupled to a fence.

Furthermore, transportable or movable barriers for defining a confined or protected area, and which can be rapidly deployed, are well known. Typically, such barriers include one or more concertina coils which are stored in a compressed fashion and axially extended to deploy. The concertina coils may be constructed from a variety of diameters and include a variety of barbed configurations.

SUMMARY OF THE DISCLOSURE

In view of the foregoing, there is a need in the art for a deployable enclosure having a plurality of connected razor wire panels.

In one or more embodiments, an enclosure may include a plurality of panel sections rotatably coupled together, at least one panel section of the plurality of panel sections including a first frame component directly coupled to a second frame component of an adjacent panel section. The enclosure may further include a razor wire panel extending across each of plurality of panel sections.

In one or more embodiments, a razor wire barrier may include a plurality of panel sections rotatably coupled together, at least one panel section of the plurality of panel sections including a first frame component directly coupled to a second frame component of an adjacent panel section. The razor wire barrier may further include a razor wire panel extending across the at least one panel section, wherein the razor wire panel is coupled to the first frame component.

In one or more embodiments, a method of operating a barrier may include providing a plurality of panel sections rotatably coupled together, at least one panel section of the plurality of panel sections including a first frame component directly coupled to a second frame component of an adjacent panel section. The method may further include providing a razor wire panel extending across each of plurality of panel sections, and permitting movement of the plurality of panel sections between a first configuration and a second configuration. In the first configuration, two or more panel sections of the plurality of panel sections are collapsed together, and in the second configuration the two panel sections of the plurality of panel sections are expanded apart.

BRIEF DESCRIPTION OF THE DRAWINGS

The accompanying drawings illustrate exemplary approaches of the disclosure, including the practical application of the principles thereof, and in which.

Figure 1:
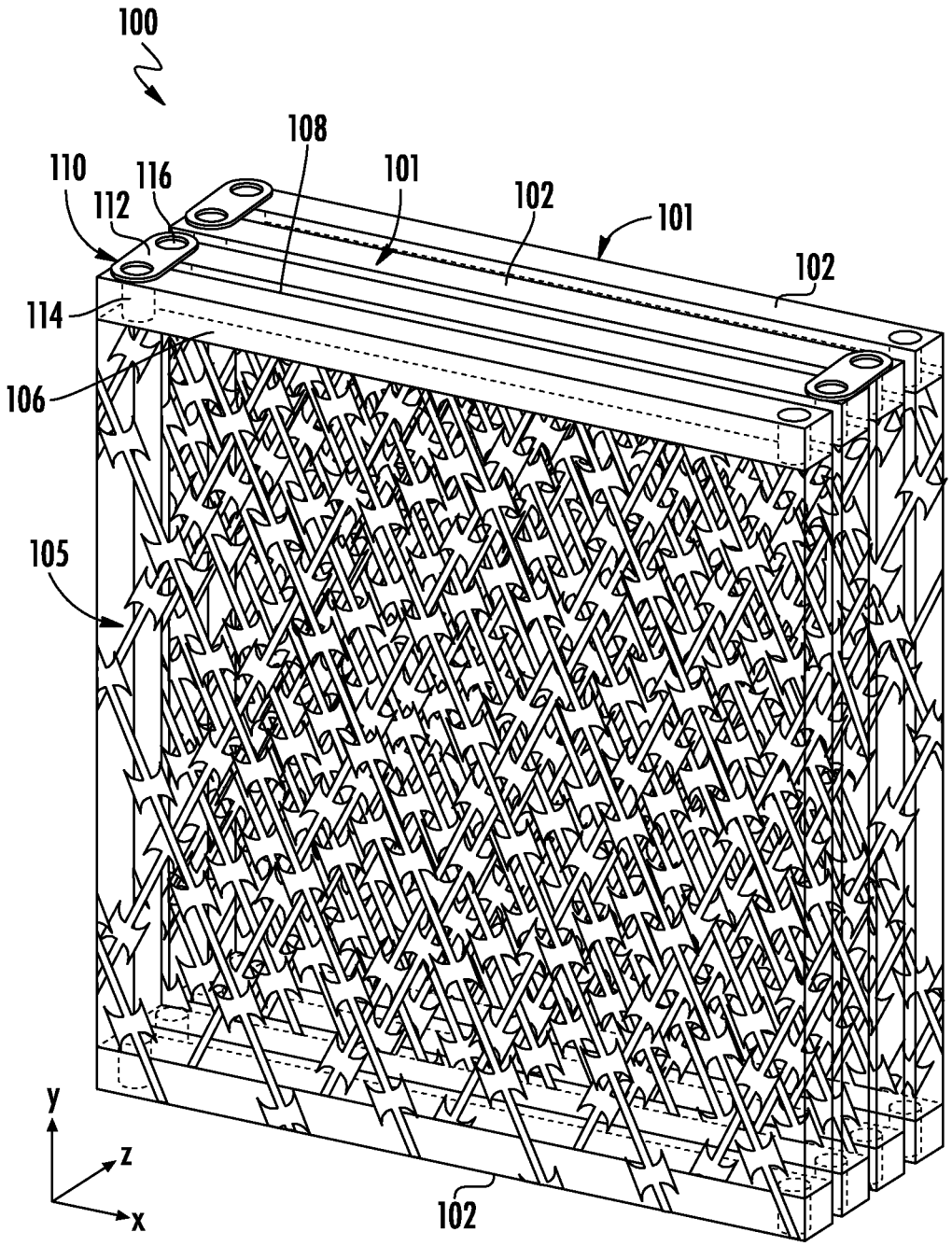
FIG. 1 is a perspective view of a razor wire barrier in a collapsed configuration, according to exemplary approaches of the disclosure.

The drawings are not necessarily to scale. The drawings are merely representations, not intended to portray specific parameters of the disclosure. Furthermore, the drawings are intended to depict exemplary embodiments of the disclosure, and therefore is not considered as limiting in scope.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

The present disclosure will now proceed with reference to the accompanying drawings, in which various barriers and methods for deploying are shown. It will be appreciated, however, that the disclosed barrier may be embodied in many different forms and should not be construed as limited to the approaches set forth herein. Rather, these approaches are provided so that this disclosure will be thorough and complete, and will fully convey the scope of the disclosure to those skilled in the art. In the drawings, like numbers refer to like elements throughout.

A barrier including a plurality of panels of razor wire is disclosed herein. In some embodiments, an enclosure includes a plurality of panel frame components rotatably coupled together, and a plurality of panels of razor wire coupled to the plurality of frame components. The plurality of panels of razor wire and the plurality of frame components may be deployed in an expanding accordion-type manner. The enclosure may also be collapsed such that the plurality of panels of razor wire are stacked parallel to one another.

Each frame will be connected to each other and will allow the entire unit to be pulled out, unfolding each section and creating a continuous wall when fully unfolded. Razor panels may have barbed tape on no sides, one side, or both sides. There can be as many razor panels sections as required.

Figure 2:
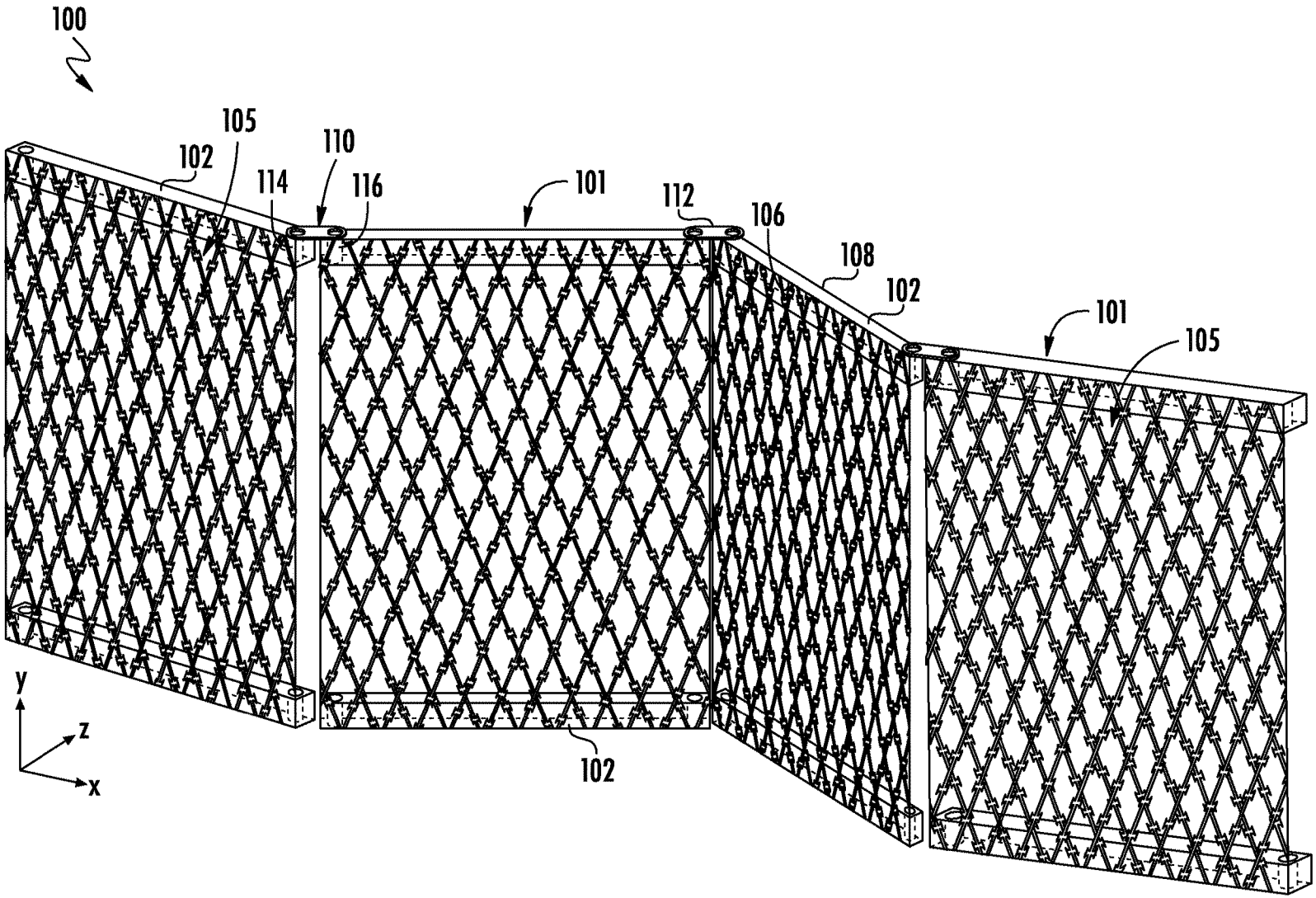
FIG. 2 is a perspective view of the razor wire barrier of FIG. 1 in a partially expanded configuration, according to exemplary approaches of the disclosure.
Figure 3:
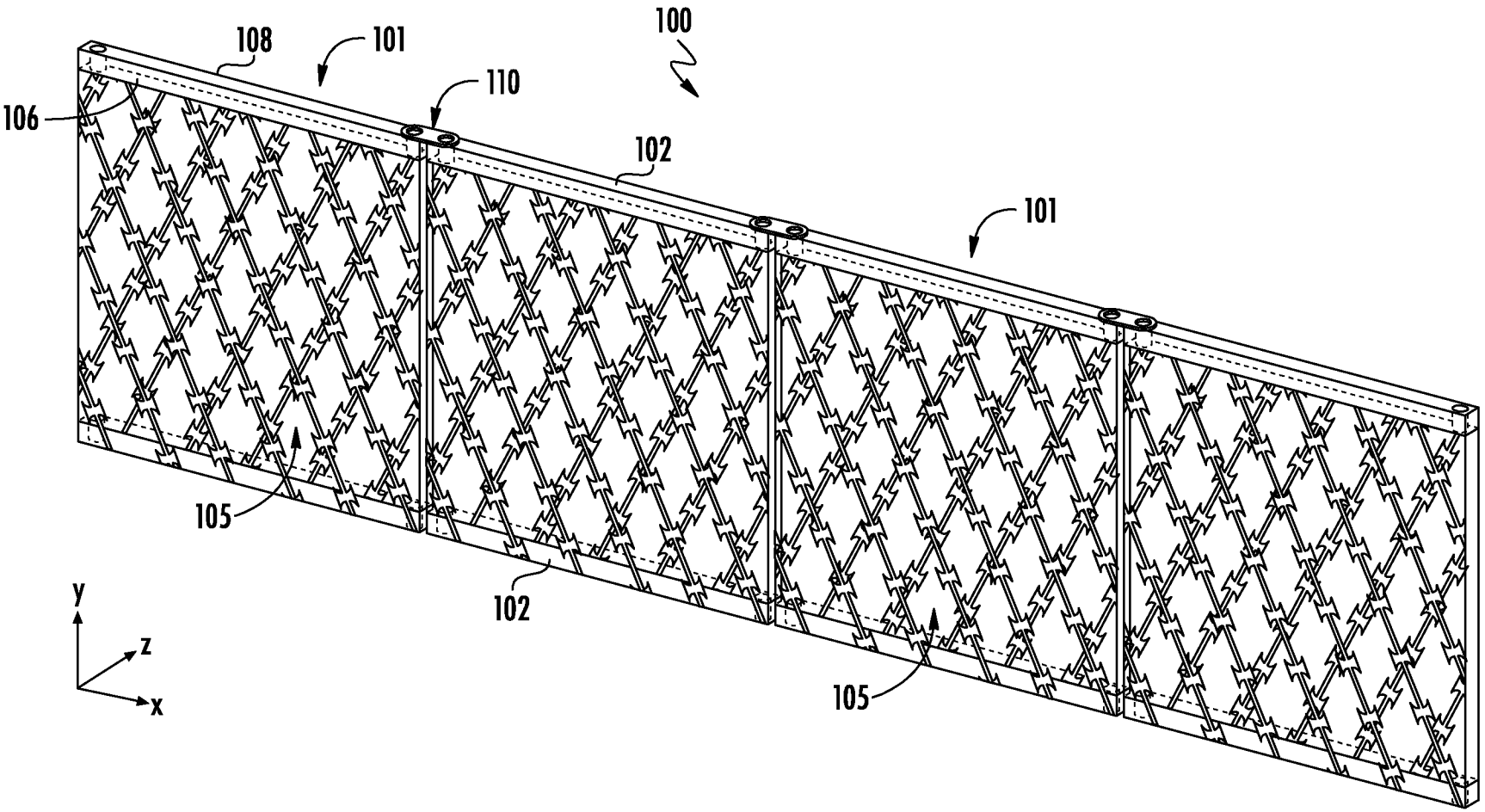
FIG. 3 is a perspective view of the razor wire barrier of FIG. 1 in a fully expanded configuration, according to exemplary approaches of the disclosure.

Referring now to FIGS. 1-3, a razor wire barrier (hereinafter "barrier") 100 will be described in greater detail. As shown, the barrier 100 may include a plurality of panel sections 101 rotatably coupled together. Each of the panel sections 101 may include frame components 102. As shown, at least one panel section 101 includes a first frame component 102 directly coupled to a second frame component 102 of a directly adjacent panel section 101. In some embodiments, each of the plurality of frame components 102 may be rigid and substantially straight. As shown, the frame components 102 may be rectangularly shaped. However, the frame components 102 may take on any variety of shapes. In exemplary embodiments, each of the frame components 102 has substantially the same dimensions.

As further shown, the barrier 100 includes a plurality of razor wire mesh or panels 105 coupled to each of the frame components 102. The razor wire panels 105 extend across each of the panel sections 101. "Razor wire" may be interchangeably known as razor ribbon, ribbon tape, or barbed tape. In non-limiting embodiments, a single razor wire panel 105 is directly coupled to two parallelly arranged frame components 102, such as a first frame component 102 extending along a top of at least one panel section 101, and a bottom frame component 102 extending along a bottom of the panel section 101. In other embodiments, two razor wire panels 105 are coupled to a same frame component 102. For example, each component 102 may have a first side or surface 106 and a second side or surface 108. One razor wire panel 105 may be coupled to the first surface 106, and a second razor wire panel 105 may be coupled to the second surface 108. In other embodiments, the razor wire panel 105 may be connected to the component 102 in an area disposed between the first and second surfaces 106, 108. For example, an end of the razor wire panel 105 may terminate within an internal area of the component 102 such that the first and second surfaces 106, 108 extend around the end of the razor wire panel 105. Because the first and second surfaces 106, 108 of the component 102 extend outwardly (e.g., along the z-axis) beyond the razor wire panel 105, the component 102 may prevent adjacent razor wire panels 105 from contacting and positionally damaging one another when the barrier is in a collapsed position. The razor wire panels 105 may be joined to the frame components 102 by virtually any means. As shown, each of the razor wire panels 105 is generally rectangular in shape. However, the razor wire panels 105 may take on any variety of shapes. In exemplary embodiments, each razor wire panel 105 has substantially the same dimensions.

In some embodiments, one or more of the razor wire panels 105 includes one or more reinforcing members, which may be difficult to penetrate or break. Thus to ensure an optimum deterrent effect, the spacing between pairs of adjacent members, in a horizontal direction and/or in a vertical direction, should be such that even if the mesh material is cut, and removed, the resulting gap or gaps in the razor wire panel 105 are so small that an assailant would not easily be able to pass through a gap.

Each of the frame components 102 is rotatably coupled to an adjacent frame component 102. In some embodiments, a hinge 110 may join frame components 102 together. Although non-limiting, the hinge 110 may include a plate 112 and first and second pins 114, 116 coupled to the plate 112. As shown, the first pin 114 may be coupled to one frame component 102, while the second pin 116 may be coupled another frame component 102. As a result, the barrier 100 is collapsible into the configuration shown in FIG. 1, and expandable to the configurations shown in FIGS. 2-3. As shown in FIG. 1, the plurality of razor wire panels 105 are stacked atop, and oriented parallel to, one another. That is, an x-y plane of each of the razor wire panels 105 is oriented parallel, or substantially parallel, to one another. In some embodiments, the perimeter of each razor wire panel 105 is aligned with and shares a same footprint, e.g., projected in the z-direction, with all other razor wire panels 105.

In some embodiments, each razor wire panel 105 may be arranged as a mesh in which a first plurality of wire strands is positioned across a second plurality of wire strands. In some embodiments, the first and second plurality of wire strands and may be interwoven. In other embodiments, the first plurality of wire strands may not be interwoven with the second plurality of wire strands and, instead, may be positioned directly adjacent one another. In yet other embodiments, the first and second plurality of wire strands and are integrally formed. Although shown in a crisscross diamond configuration, it'll be appreciated that the first and second plurality of wire strands and may also be oriented perpendicular to one another in other embodiments.

In a non-limiting embodiment, a height of each of the razor wire panel 105 is preferably substantially in excess of the height of an average human. Furthermore, in the expanded configuration of the barrier 100 shown in FIG. 3, the frame components 102 and/or the razor wire panels 105 may be attached to additional structures (not shown) to prevent the barrier 100 from tipping over. This may include attaching to an existing fence or structure, or utilizing concrete blocks at the bottom to prevent the barrier from tipping or being moved.

Figure 4:
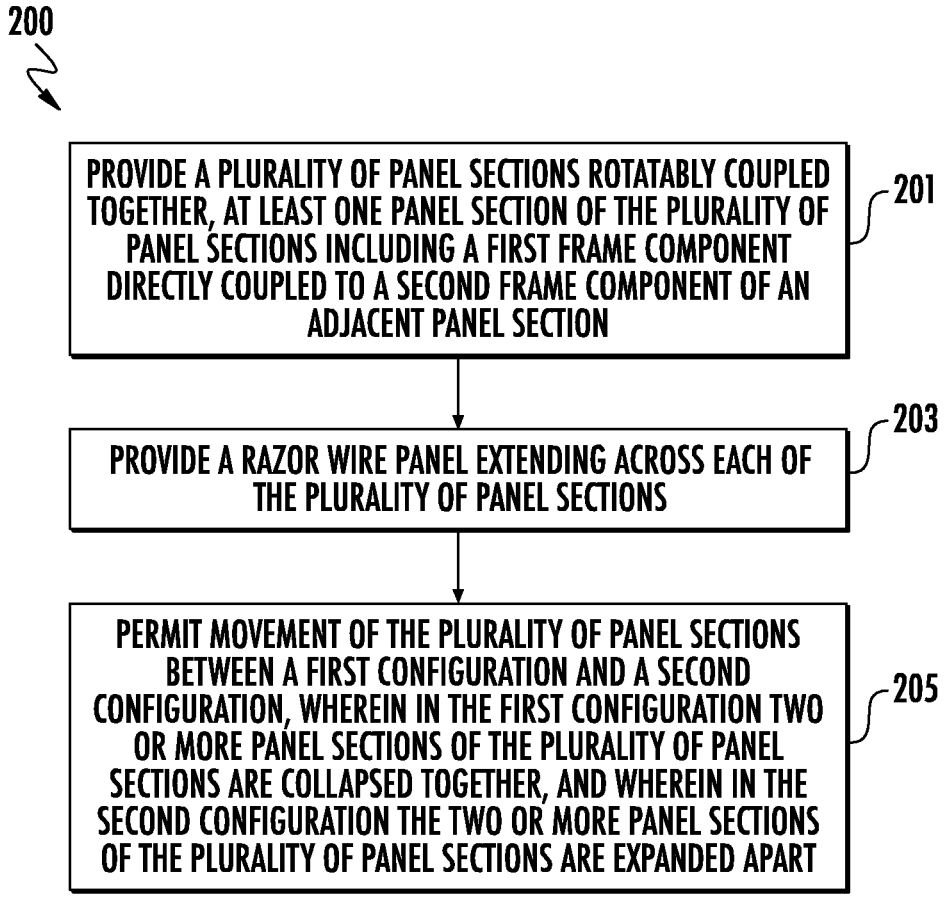
FIG. 4 is a method for operating a barrier according to exemplary approaches of the disclosure.

Turning now to FIG. 4, a method 200 for operating the barrier 100 of FIGS. 1-3 according to embodiments of the disclosure will be described in greater detail. At block 201, the method may include providing a plurality of panel sections rotatably coupled together, at least one panel section of the plurality of panel sections including a first frame component directly coupled to a second frame component of an adjacent panel section. In some embodiments, the first and second frame components are coupled together using a hinge or other similar connection device. At block 203, the method 200 may include providing a razor wire panel extending across each of the plurality of panel sections. In some embodiments, the first frame component extends along a top of the at least one panel section, and wherein the first frame component extends parallel to a bottom frame component extending along a bottom of the at least one panel section. In some embodiments, the razor wire panel extends between the first frame component and the second frame component.

At block 205, the method 200 may include permitting movement of the plurality of panel sections between a first configuration and a second configuration, wherein in the first configuration two or more panel sections of the plurality of panel sections are collapsed together, and wherein in the second configuration the two panel sections of the plurality of panel sections are expanded apart. In the first configuration, each of the plurality of panels of razor wire are oriented parallel to one another along different planes. In some embodiments, the plurality of razor wire panels are deployed in an accordion-type manner when the barrier is expanded.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

Still furthermore, although the illustrative method 200 is described above as a series of acts or events, the present disclosure is not limited by the illustrated ordering of such acts or events unless specifically stated. For example, some acts may occur in different orders and/or concurrently with other acts or events apart from those illustrated and/or described herein, in accordance with the disclosure. In addition, not all illustrated acts or events may be required to implement a methodology in accordance with the present disclosure. Furthermore, the method 200 may be implemented in association with the formation and/or processing of structures illustrated and described herein as well as in association with other structures not illustrated.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. An enclosure, comprising:

a plurality of panel sections rotatably coupled together along adjacent edges of the panel sections, wherein the plurality of panel sections is collapsed in a first stacked configuration and expanded in a second configuration, at least one panel section of the plurality of panel sections comprising:

a first upper frame component extending along a top of the at least one panel section, the first upper frame component being rotatably coupled to a second upper frame component of an adjacent panel section; and a first bottom frame component extending along a bottom of the at least one panel section, the first bottom frame component rotatably coupled to a second bottom frame component of the adjacent panel section, wherein each of the first upper frame component, the second upper frame component, the first bottom frame component, and the second bottom frame component comprises a flat interior surface opposite a flat exterior surface thereof and an internal area between the flat interior surface and the flat exterior surface; and a first razor wire panel and a second razor wire panel extending across the at least one panel section of the plurality of panel sections, between the first upper frame component and the first bottom frame component, wherein the first and second razor wire panels are separated from one another by a gap, wherein a plurality of wire strands of the first razor wire panel are directly coupled to the flat exterior surface of the first upper frame component and to the flat exterior surface of the first bottom frame component, and wherein a plurality of wire strands of the second razor wire panel are directly coupled to the flat interior surface of the first upper frame component and to the flat interior surface of the first bottom frame component;

a third razor wire panel and a fourth razor panel extending across the adjacent panel section, between the second upper frame component and the second lower frame component, wherein the third and fourth razor wire panels are separated from one another by a gap, wherein a plurality of wire strands of the third razor wire panel are directly coupled to the flat exterior surface of the second upper frame component and to the Hat exterior surface of the second bottom frame component, and wherein a plurality of wire strands of the fourth razor wire panel are directly coupled to the flat interior surface of the second upper frame component and to the flat interior surface of the second bottom frame component.

2. The enclosure of claim 1, further comprising a hinge coupling together the first upper frame component and the second upper frame component.

3. The enclosure of claim 2, wherein the hinge comprises:

a plate; and a first pin and a second pin coupled to the plate, wherein the first pin is directly coupled to the first upper frame component, and wherein the second pin is directly coupled to the second upper frame component.

4. The enclosure of claim 1, wherein the first upper frame component extends parallel to the first bottom frame component.

5. The enclosure of claim 1, the first razor wire panel having a generally rectangular configuration.

6. The enclosure of claim 1, wherein two or more panel sections of the plurality of panel sections extend parallel to one another along different planes in the first configuration.

7. The enclosure of claim 1, wherein two or more panel sections of the plurality of panel sections extend along a same plane in the second configuration.

8. A razor wire barrier, comprising:

a plurality of panel sections rotatably coupled together along adjacent edges of the panel sections, wherein the plurality of panel sections is collapsed in a first stacked configuration and expanded in a second configuration, at least one panel section of the plurality of panel sections comprising:

a first upper frame component extending along a top of the at least one panel section, the first upper frame component being rotatably coupled to a second upper frame component of an adjacent panel section; and a first bottom frame component extending along a bottom of the at least one panel section, the first bottom frame component rotatably coupled to a second bottom frame component of the adjacent panel section, wherein each of the first upper frame component, the second upper frame component, the first bottom frame component, and the second bottom frame component comprises a flat interior surface opposite a flat exterior surface thereof and an internal area between the flat interior surface and the flat exterior surface;

a first razor wire panel and a second razor wire panel extending between the first upper frame component and the first bottom frame component, wherein the first and second razor wire panels extend parallel to one another and are separated from one another by a gap, wherein a plurality of wire strands of the first razor wire panel are directly coupled to the flat exterior surface of the first upper frame component and to the flat exterior surface of the second upper frame component, and wherein a plurality of wire strands of the second razor wire panel are directly coupled to the flat interior surface of the first upper frame component and to the flat interior surface of the first bottom frame component; and a third razor wire panel and a fourth razor panel extending across the adjacent panel section, between the second upper frame component and the second lower frame component, wherein the third and fourth razor wire panels extend parallel to one another and are separated from one another by a gap, wherein a plurality of wire strands of the third razor wire panel are directly coupled to the flat exterior surface of the second upper frame component and to the Hat exterior surface of the second bottom frame component, and wherein a plurality of wire strands of the fourth razor wire panel are directly coupled to the flat interior surface of the second upper frame component and to the flat interior surface of the second bottom frame component.

9. The razor wire barrier of claim 8, further comprising a hinge coupling together the first upper frame component and the second upper frame component.

10. The razor wire barrier of claim 9, wherein the hinge comprises:

a plate; and a first pin and a second pin coupled to the plate, wherein the first pin is directly coupled to the first upper frame component, and wherein the second pin is directly coupled to the second upper frame component.

11. The razor wire barrier of claim 8, wherein the first upper frame component extends parallel to the first bottom frame component.

12. The razor wire barrier of claim 8, each razor wire panel having a generally, planar, rectangular configuration.

13. The razor wire barrier of claim 8, wherein two or more panel sections of the plurality of panel sections extend parallel to one another along different planes in the first configuration, and wherein two or more panel sections of the plurality of panel sections extend along a same plane in the second configuration.

14. A method of operating a barrier, comprising:

providing a plurality of panel sections rotatably coupled together along adjacent edges of the panel sections, at least one panel section of the plurality of panel sections including a first upper frame component rotatably coupled to a second upper frame component of an adjacent panel section, wherein the first upper frame component extends along a top of the at least one panel section, wherein a first bottom frame component extends along a bottom of the at least one panel section, the first bottom adjacent panel section, wherein the second upper frame component extends along a top of the adjacent panel section, wherein each of the first upper frame component, the second upper frame component the first bottom frame component, and the second bottom frame component comprises a flat interior surface opposite a flat exterior surface thereof and an internal area between the flat interior and flat exterior surfaces;

providing a first razor wire panel and a second razor panel extending between the first upper frame component and the first bottom frame component, wherein the first and second razor wire panels are separated from one another by a gap, wherein a plurality of wire strands of the first razor wire panel are directly coupled to the flat exterior surface of the first upper frame component and to the flat exterior surface of the first lower frame component, and wherein a plurality of wire strands of the second razor wire panel are directly coupled to the flat interior surface of the first upper frame component and to the flat interior surface of the first lower frame component; and permitting movement of the plurality of panel sections between a first configuration and a second configuration, wherein in the first configuration two or more panel sections of the plurality of panel sections are stackably collapsed together, and wherein in the second configuration the two panel sections of the plurality of panel sections are expanded apart.

15. The method of claim 14, further comprising coupling together the first upper frame component and the second upper frame component using a hinge.

16. The method of claim 14, wherein the first upper frame component extends parallel to the first bottom frame component.

* * * * *